US010119304B2

(12) United States Patent
Meech

(10) Patent No.: US 10,119,304 B2
(45) Date of Patent: Nov. 6, 2018

(54) POINT OF SALE ASSEMBLY HAVING ANTITHEFT FUNCTIONALITY AND METHOD THEREOF

(71) Applicant: The Gillette Company, Boston, MA (US)

(72) Inventor: James Arthur Meech, Sharon, MA (US)

(73) Assignee: The Gillette Company LLC, Boston, MA (US)

( * ) Notice: Subject to any disclaimer, the term of this patent is extended or adjusted under 35 U.S.C. 154(b) by 10 days.

(21) Appl. No.: 15/009,682

(22) Filed: Jan. 28, 2016

(65) Prior Publication Data

US 2017/0218663 A1 Aug. 3, 2017

(51) Int. Cl.

| | |
|---|---|
| ***G08B 13/14*** | (2006.01) |
| ***E05B 73/00*** | (2006.01) |
| ***B65D 25/20*** | (2006.01) |
| ***G08B 13/06*** | (2006.01) |
| ***A47F 7/024*** | (2006.01) |
| ***G08B 13/24*** | (2006.01) |
| ***A47F 3/00*** | (2006.01) |

(52) U.S. Cl.

CPC ..... *E05B 73/0017* (2013.01); *A47F 3/002* (2013.01); *A47F 7/024* (2013.01); *B65D 25/20* (2013.01); *G08B 13/06* (2013.01); *G08B 13/1445* (2013.01); *G08B 13/1463* (2013.01); *G08B 13/2402* (2013.01); *G08B 13/2434* (2013.01); *G08B 13/2457* (2013.01)

(58) Field of Classification Search

None

See application file for complete search history.

(56) References Cited

U.S. PATENT DOCUMENTS

| | | | | |
|---|---|---|---|---|
| 659,199 | A | 10/1900 | Anderton | |
| 857,778 | A | 6/1907 | Wittstein | |
| 1,742,982 | A | 1/1930 | Wittstein | |
| 3,668,681 | A * | 6/1972 | Kaplan | G08B 13/1463 340/537 |
| 4,074,637 | A | 2/1978 | Lorenzen, Jr. | |
| 4,865,352 | A | 9/1989 | Gollon | |
| 5,370,231 | A | 12/1994 | Nieto | |
| D363,087 | S | 10/1995 | McAuley | |
| 5,535,878 | A | 7/1996 | Reed | |
| D379,100 | S | 5/1997 | McAuley et al. | |

(Continued)

FOREIGN PATENT DOCUMENTS

| | | |
|---|---|---|
| EP | 2810588 A1 | 12/2014 |
| WO | WO 2015/118251 | 8/2015 |

OTHER PUBLICATIONS

PCT Search Report with Written Opinion in corresponding international application PCT/US2017/012660 dated Apr. 18, 2017.

*Primary Examiner* — Julie Lieu

(74) *Attorney, Agent, or Firm* — John M. Lipchitz

(57) ABSTRACT

A point of sale assembly having antitheft functionality. A sealed consumer product package has a face with at least one opening extending into the sealed consumer product package. A consumer product is positioned inside the sealed consumer product package. A lock having a sensor and a body that is positioned outside the sealed consumer product package. The lock has at least one locking arm extending into the opening of the sealed consumer product package and secured to the consumer product.

7 Claims, 6 Drawing Sheets

(56) References Cited

U.S. PATENT DOCUMENTS

| | | | | |
|---|---|---|---|---|
| D385,579 | S | 10/1997 | McAuley et al. | |
| 5,720,498 | A | 2/1998 | McAuley et al. | |
| 6,237,375 | B1 | 5/2001 | Wymer | |
| 6,672,455 | B2 * | 1/2004 | Belden, Jr. | E05B 17/0062 206/1.5 |
| 7,183,914 | B2 | 2/2007 | Norman et al. | |
| 7,321,308 | B1 | 1/2008 | Feibelman | |
| 8,590,699 | B2 * | 11/2013 | Feibelman | G09F 3/037 206/6.1 |
| 8,752,406 | B2 | 6/2014 | Shute et al. | |
| 9,038,898 | B2 | 5/2015 | Cooper | |
| 2004/0145473 | A1 | 7/2004 | Royer | |
| 2005/0268672 | A1 * | 12/2005 | Fraser | E05B 73/0023 70/57.1 |
| 2007/0120686 | A1 | 5/2007 | Spagna | |
| 2014/0260442 | A1 * | 9/2014 | Brown | E05B 73/0011 70/58 |
| 2014/0306073 | A1 * | 10/2014 | Steber | A47F 7/024 248/176.1 |
| 2015/0077256 | A1 * | 3/2015 | Maddox | G08B 13/2431 340/572.1 |

* cited by examiner

POINT OF SALE ASSEMBLY HAVING ANTITHEFT FUNCTIONALITY AND METHOD THEREOF

FIELD OF THE INVENTION

The present invention relates to display packages for consumer products and more particularly, to consumer product packages having anti-theft functionality.

BACKGROUND OF THE INVENTION

Consumer products are incorporating more innovation to provide consumers with improved user experiences. However, innovative consumer products are more expensive and thus are more likely to be stolen at the retail shelf by shoplifters. Shoplifters typically look for products that are compact, relatively expensive and can be sold for near-retail prices. For example, razors and razor blade cartridges are typically expensive, small in size, have a high resale value and are in high demand, especially for more premium brands. Similar to razors and razor blades, electric toothbrushes and their corresponding replacement heads are also commonly shoplifted items. Teeth whitening strips are another dental hygiene product with a high theft rate in retail stores. Furthermore, with the advancement of e-commerce the shoplifting industry is growing because of the increased ease of selling of stolen products over the internet.

Consumer product companies and retailers have had limited success with packages that are more difficult to tear or cut open. However, this does not deter shoplifters. These packages also frustrate legitimate consumers because of the difficulty of opening the package without the aid of a sharp tool. Furthermore, shoplifters may cut open the package, remove the product and still sell the product without packaging on the internet. For example, razors cartridges are typically sold four cartridges within a plastic dispenser that is then packaged. Shoplifters may cut open the package and just sell the cartridges within the dispenser on the internet. Consumer product companies have also had only limited success with sealing an anti-theft tag within the package that sets off an alarm when exiting the store. These theft tags may not always be deactivated properly at check out. This technology also does not prevent shoplifters from cutting open the package in the store and removing the product. In addition, the anti-theft tags that are sealed in the consumer package add cost to the product, which is typically passed to the consumer. Despite the use of known packaging techniques, there remains a need to further modify consumer product packages to hamper product theft.

SUMMARY OF THE INVENTION

In one aspect, the invention features, in general, a method of providing a point of sale assembly having antitheft functionality. A lock having a sensor, a body and at least one locking arm is provided. The at least one locking arm is inserted through a corresponding opening of a sealed consumer package that contains a consumer product. The locking arm is secured to the consumer product.

In another aspect, the invention features, in general, a point of sale assembly having antitheft functionality with a sealed consumer product package having a face with at least one opening extending into the sealed consumer product package. A consumer product is positioned inside the sealed consumer product package. A lock having a sensor and a body that is positioned outside the sealed consumer product package. The lock has at least one locking arm extending into the opening of the sealed consumer product package and secured to the consumer product.

In yet another aspect, the invention features, in general, a consumer product with a sealed consumer product package defining a cavity. The sealed consumer product package has a face with at least one opening dimensioned to receive a locking arm. An organizer is positioned within the cavity. The organizer has at least one engagement surface aligned with the at least one opening.

DETAILED DESCRIPTION OF THE INVENTION

Figure 1:
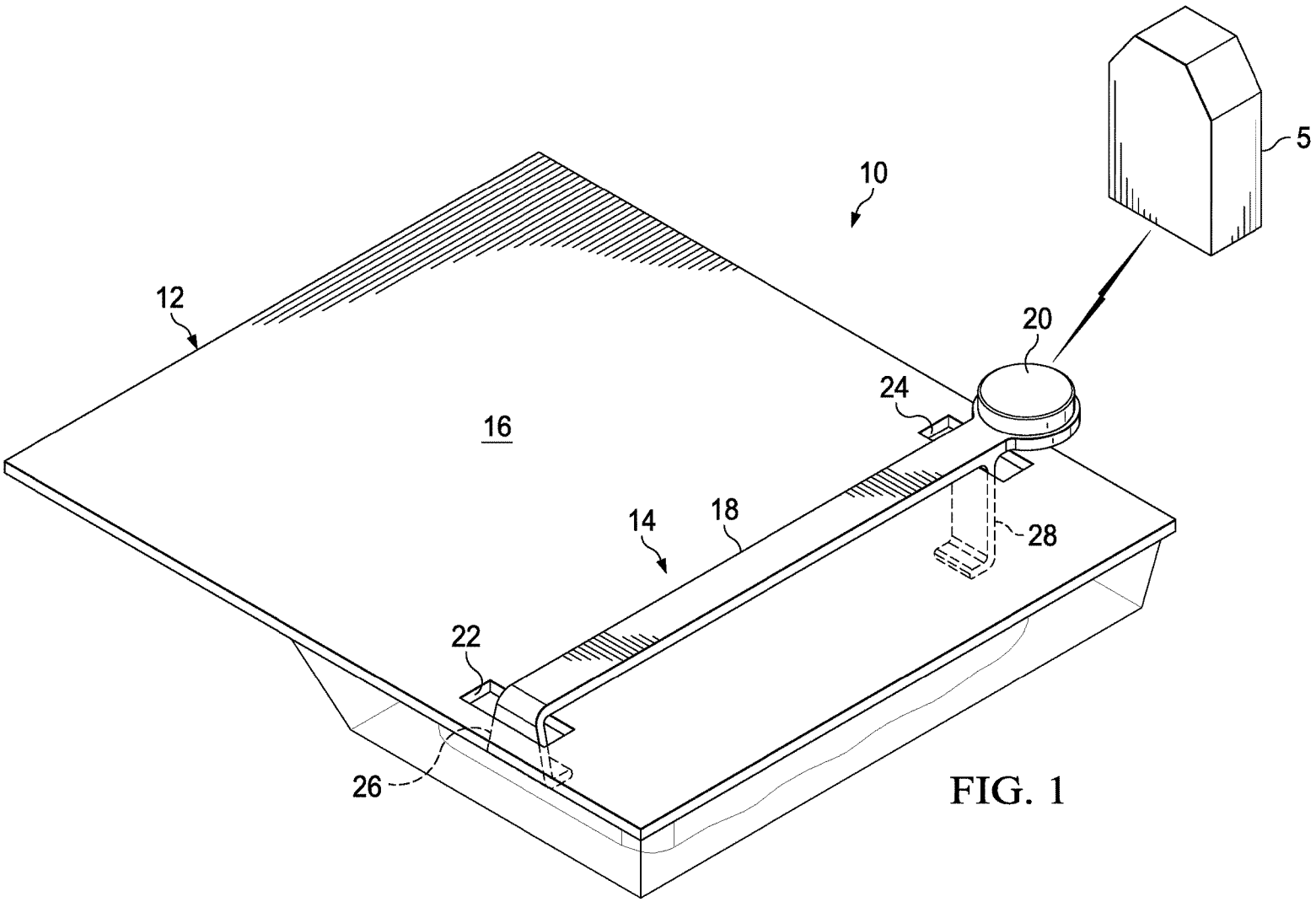
FIG. 1 is a rear perspective view of a point of sale assembly having anti-theft functionality with an alarm system.

Referring to FIG. 1, one possible embodiment of the present invention is shown illustrating an alarm system 5 associated with a point of sale assembly having anti-theft functionality 10. The point of sale assembly having anti-theft functionality 10 may be mounted to a hanging display (e.g., a peg board) and/or displayed on a store shelf. The point of sale assembly having anti-theft functionality 10 may include a sealed consumer product package 12 and a lock 14. The sealed consumer product package 12 may be sealed to prevent damage or access to the consumer product. The sealed consumer product package 12 may have a face 16. The face 16 may be consumer facing or any other external surface of the sealed consumer product package 12. The sealed consumer product package 12 may contain one or more consumer products (not shown) secured to the lock 14. It is understood that the consumer product package 12 may include any type of cardboard packs or blister packs, including, but not limited to card blisters and clamshells. In certain embodiments, the sealed consumer product package 12 may be formed from plastic, paperboard and/or renewable materials (e.g., bulrush, wheat stalk, rice hull, bamboo, and combinations thereof).

The lock 14 may have a body 18 and a sensor 20 that are external of the sealed consumer product package 12. In certain embodiments, the lock 14 and/or sensor 20 may extend beyond the sealed consumer package 12 so it is clearly visible to a consumer or potential shoplifter. The positioning of the lock body 18 and/or sensor 20 external of the consumer product package 12 and clearly visible, may further deter shoplifters from stealing the point of sale assembly having anti-theft functionality 10. For example, if potential shoplifters are aware a product has an anti-theft device, then they are less likely to try to steal it. The sensor 20 may be in communication with the store alarm system 5. Accordingly, if the lock 14 is not removed from the sealed consumer product package 12 prior to leaving the store, the sensor 20 may trigger the alarm system 5, notifying store security. As will be explained in greater detail below, the lock 14 may be removed by store personnel at checkout and reused for other sealed consumer product packages 12.

The sealed consumer product package 12 may have at least one opening 22 and 24 dimensioned to receive at least a portion of the lock 14. For example, the lock 14 may have at least one locking arm 26 and 28 positioned within the respective openings 22 and 24 of the consumer product package 12. In certain embodiments, the openings 22 and 24 may be spaced apart slots. Thus, the lock body 18 may span across the face 16 of the sealed consumer product package 12 (e.g., between the openings 26 and 28). The lock 14 may not be directly secured to the consumer product package 12. However, the lock 14 may not removed from the sealed consumer product package 12 unless the face 16 is cut open and the lock 14 is removed along with the consumer product (not shown) or the lock is unsecured from the consumer product.

Figure 2:
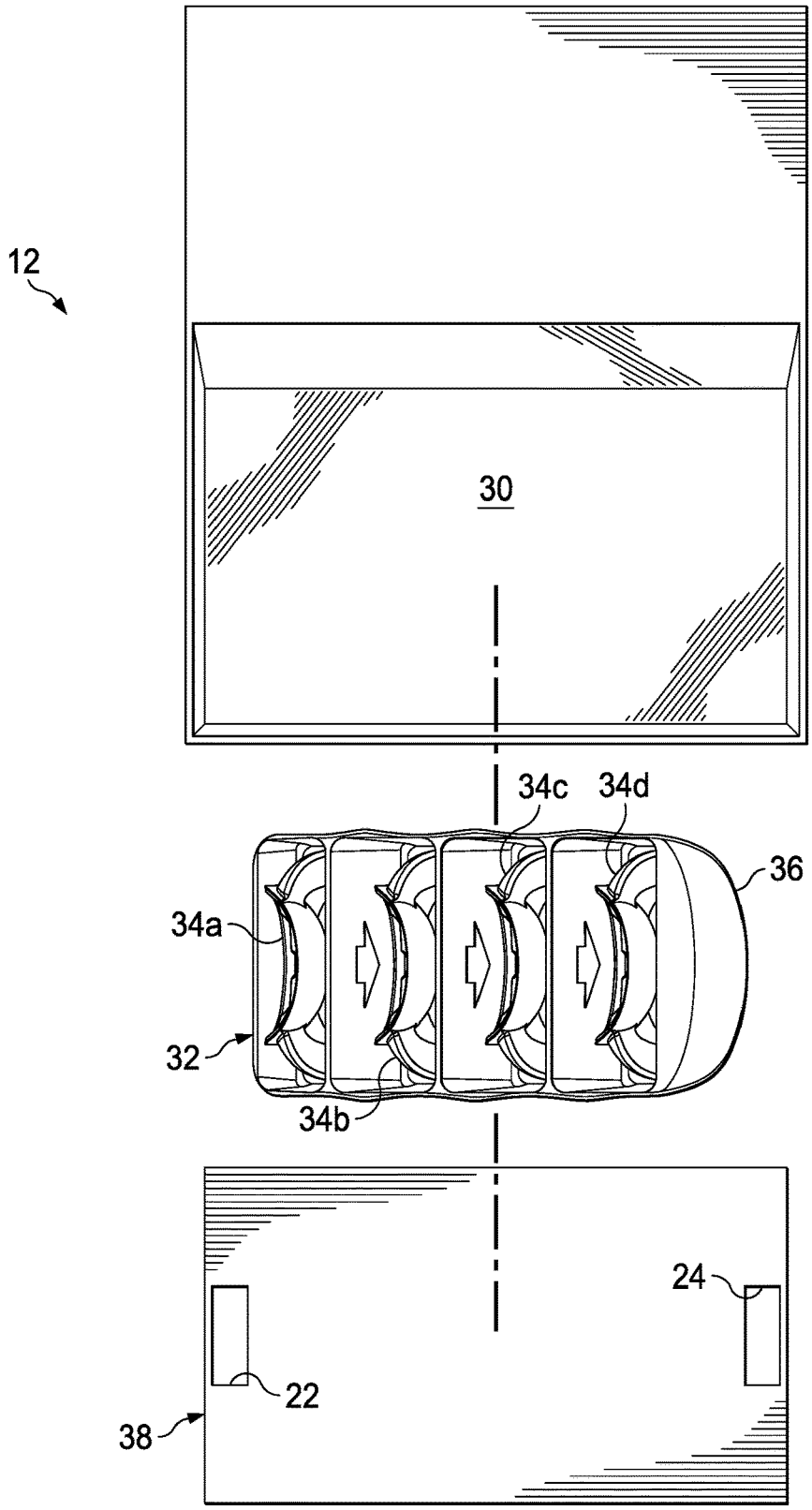
FIG. 2 is an assembly view of one possible embodiment of a sealed consumer product package that may be incorporated into the point of sale assembly having anti-theft functionality of FIG. 1.

Referring to FIG. 2, an assembly view of the sealed consumer product package 12 is shown. The sealed consumer product package 12 may define a cavity 30 dimensioned to receive at least one consumer product 32. As an example, the consumer product 32 may be one or more razor cartridges 34*a*, 34*b*, 34*c* and 34*d*. The consumer product 32 may also include an organizer 36 to store the razor cartridges 34*a*, 34*b*, 34*c* and 34*d*. It is understood the consumer product 32 may comprise a dispenser that holds other consumer items, such as toothbrushes or teeth whitening strips. Alternatively, the consumer product may comprise only the item itself (e.g., the razor cartridge 34*a*, 34*b*, 34*c* and 34*d* without the organizer 36). At least one of the openings 22 and 24 may be in communication with the cavity 30 and dimensioned to receive the locking arms 26 and 28 to allow for attachment of the lock 14 of FIG. 1 to the consumer product 32. The cavity 30 may be sealed with a lid 38 to protect the consumer product 32. In certain embodiments, one or more of the openings 22 and 24 may extend into the lid 38. However, it is also understood that the openings 22 and 24 may alternatively extend into any other portion of the sealed consumer product package 12 (e.g., an opposing face from the lid 38). The openings 22 and 24 may be punched into the sealed consumer product package 12 (e.g., the lid 38 may have perforations to allow the openings 22 and 24 to be easily punched in) or pre-formed.

Figure 3:
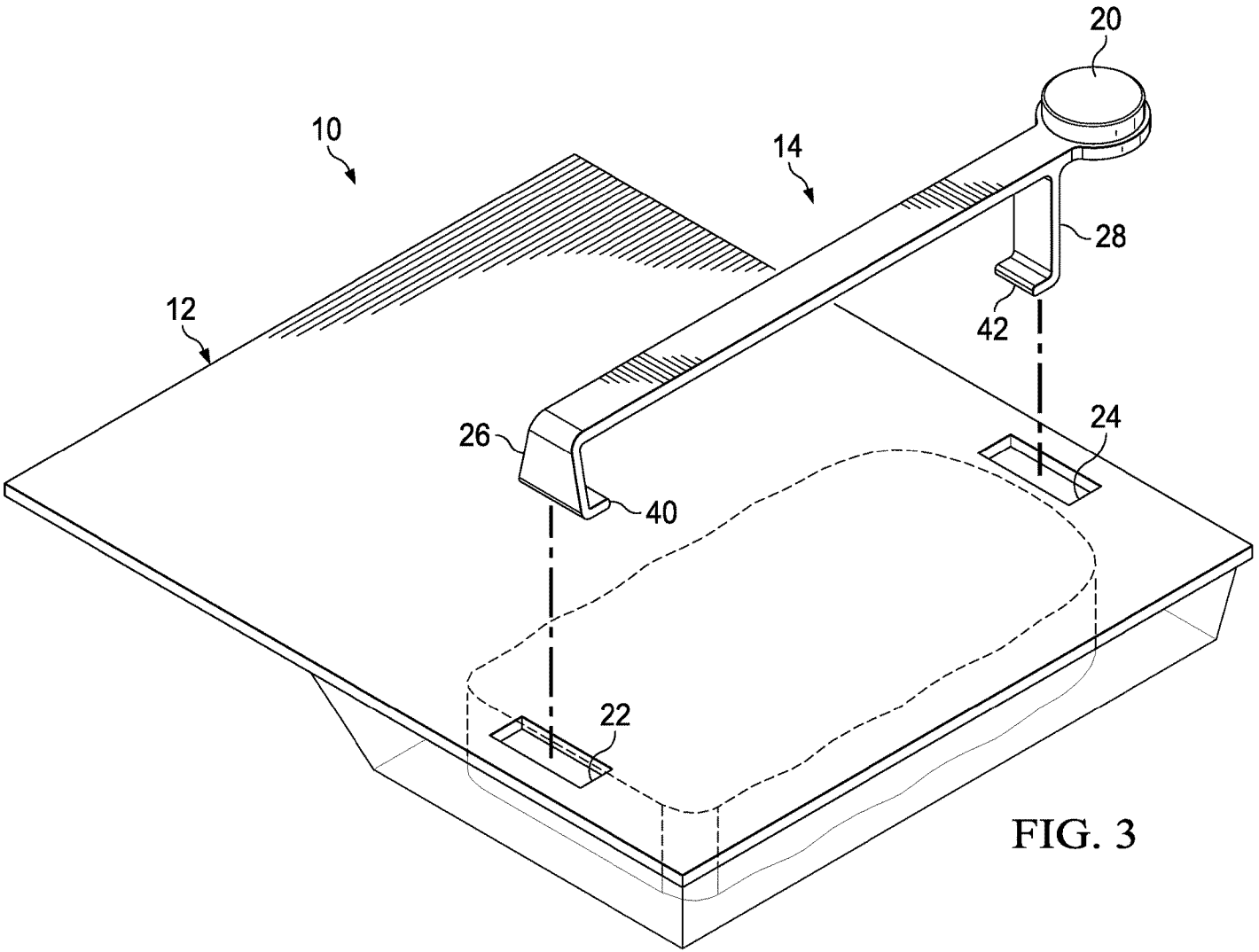
FIG. 3 is an assembly view of the point of sale assembly having anti-theft functionality of FIG. 1.

Referring to FIG. 3, an assembly view of the point of sale assembly having anti-theft functionality 10 of FIG. 1 is shown. The sealed consumer product package 12 may be provided to the retailer in a sealed configuration (as shown). The retailer may purchase or be provided the lock 14 separately. Alternatively, the lock 14 may be provided pre-mounted to the sealed consumer product package 12. The lock 14 may be placed in an open or unlocked position to enable insertion of a portion of the lock 14 into the sealed consumer product package 12. For example, at least one of the locking arms 26 and 28 may be positioned within one of the respective openings 22 and 24. The locking arms 26 and 28 may have an end with a respective clasp 40 and 42 to facilitate securing the lock 14 within the consumer product package 12. The clasps 40 and 42 may extend toward each other. In certain embodiments, the locking arms 26 and 28 may have a different length to facilitate securement to the consumer product 32 (not shown). The lock 14 may comprise a rigid material, such as metal or a strong plastic material to make it difficult for shoplifters to remove or break off. For example, a knife or scissors may not be able to cut and/or break the lock 14 and/or remove the sensor 20.

Figure 4A:
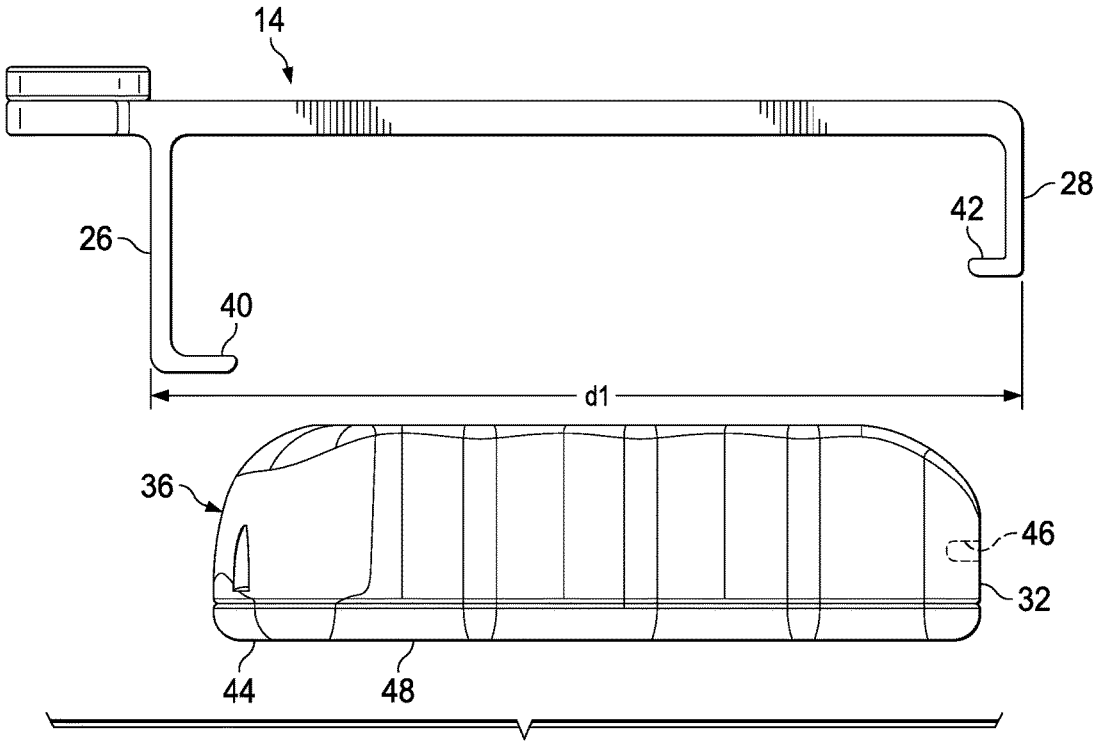
FIG. 4A is a side view of one possible embodiment of a consumer product and a lock in an unsecured position.

Referring to FIG. 4A, an assembly view of the consumer product 32 and the lock 14 are shown in the unsecured position with the consumer product package 12 removed for clarity. The consumer product 32 may have at least one retaining surface 44 and 46 that engages the corresponding clasp 40 and 42. The retaining surfaces 44 and 46 may be generally parallel to each other. In certain embodiments, one of retaining surfaces 46 may be an undercut (e.g., a notch) and/or one of the retaining surfaces 44 may be a portion of a bottom surface 48 of the consumer product 32 (e.g., organizer 36). In the open or unsecured position, the lock 14 may have a first distance "d1", as measured between the locking arms 40 and 42. The locking arms 26 and 28 may be positioned within the respective openings 22 and 24 (FIG. 3). The locking arms 26 and 28 may slide toward each other and lock into a closed or secured position.

Figure 4B:
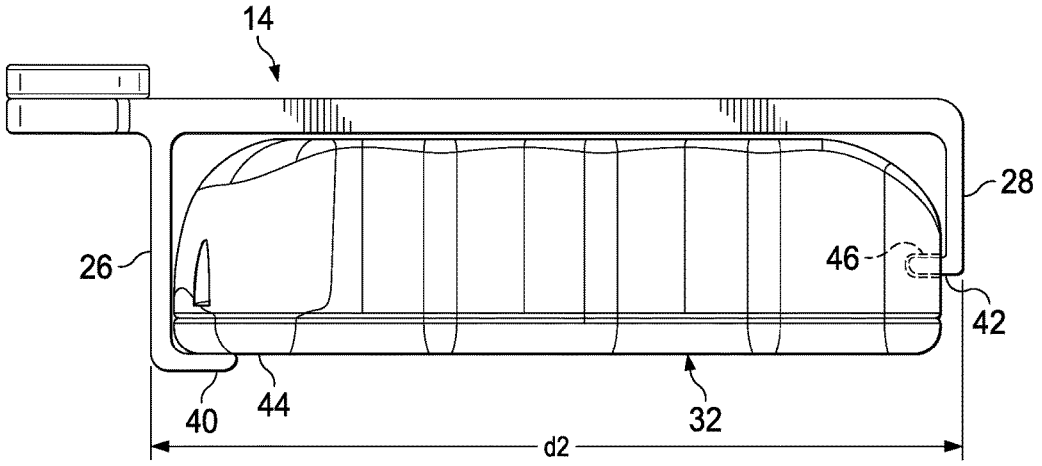
FIG. 4B is a side view of the consumer product and the lock of FIG. 4A in a secured position.

FIGS. 1 and 4B illustrate the lock 14 in the closed position. The openings 22 and 24 may be aligned (e.g., overlapping) with the engagement surfaces 44 and 46 to allow attachment and removal of the locking arms 26 and 28 by store personnel. In the closed position, the clasps 40 and 42 may engage the corresponding retaining surfaces 44 and 46 of the consumer product 32 to secure the lock 14 to the consumer product 32, as shown in FIG. 4B. Accordingly, the lock 14 is indirectly secured to the sealed consumer package 32, as shown in FIG. 1. In the closed position, the lock 14 may have a second distance "d2" between the locking arms 26 and 28 that is less than d1 to prevent the lock 14 from being removed from the consumer product 32 and/or the sealed consumer package 32. The locking arms 26 and 28, more specifically the clasp 40 and 42, may be temporarily secured to the consumer product 32 from outside of the sealed consumer product package 12 by a store clerk while stocking the sealed consumer product package 12. The lock 14 may later be removed by a store clerk at check out once payment is received. The store clerk may use a tool specifically designed for disengaging the lock 14 from the consumer product 32.

Figure 5:
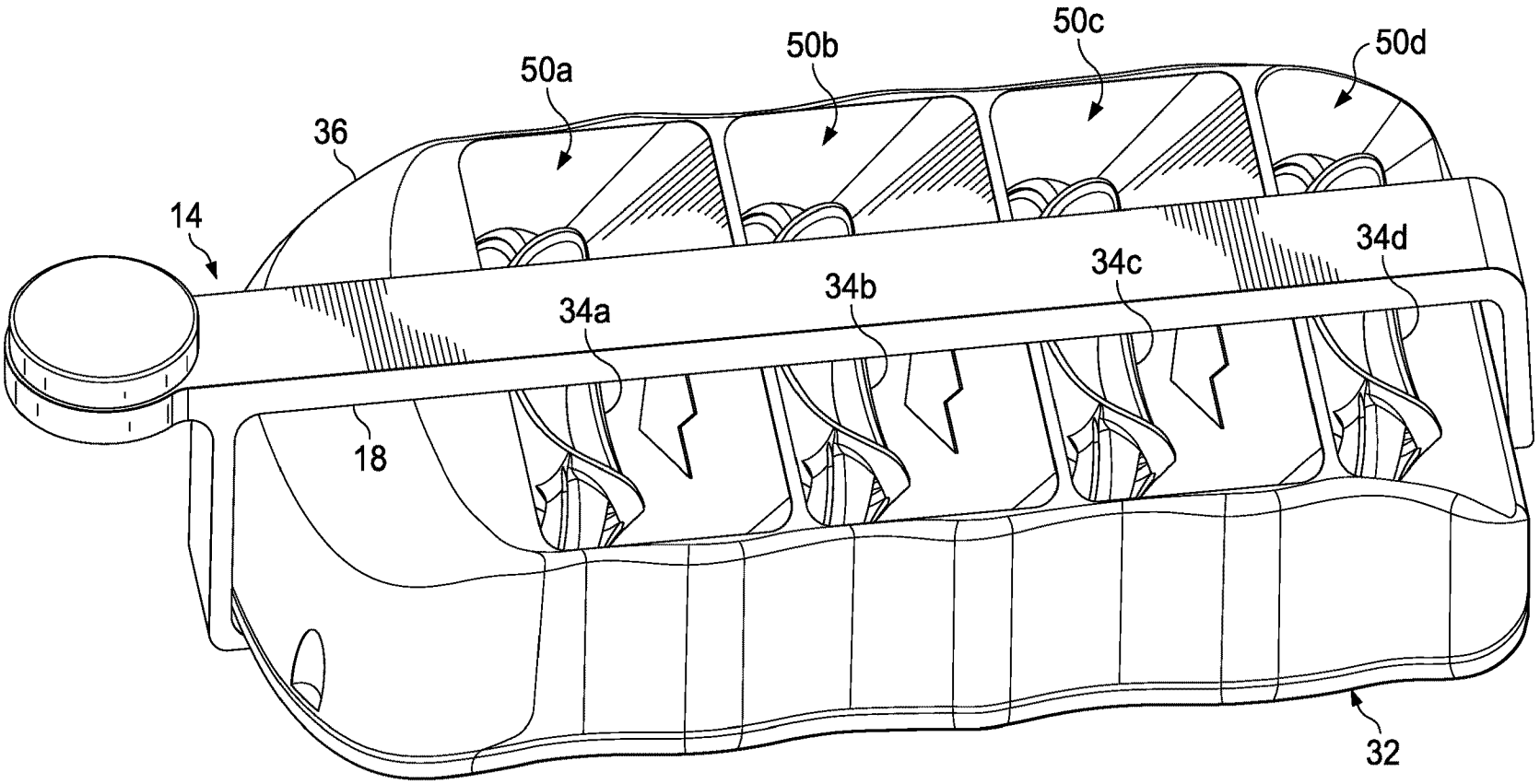
FIG. 5 is a perspective view of the consumer product and the lock of FIG. 4B.

FIG. 5 is a perspective view of the consumer product 32 and the lock 14 in the secured position, as shown in FIG. 1, but with the sealed consumer product package 12 removed for clarity. The consumer product 32 may have a plurality of spaced apart openings 50*a*, 50*b*, 50*c* and 50*d* dimensioned to receive one or more of the items (e.g., razor cartridges 34*a*, 34*b*, 34*c*, and 34*d*). The body 18 of the lock 14 may be positioned over the openings 50*a*, 50*b*, 50*c* and 50*d* to prevent one or more of the razor cartridges 34*a*, 34*b*, 34*c* and 34*d* from being removed from the organizer 36. Accordingly, the lock 14 is rigidly secured to the consumer product 32 to prevent access and/or removal of the contents of the organizer 36. A shoplifter would need to damage the consumer product 32 in order to remove the lock 14, thus making the sale of the damaged consumer product 32 less valuable. Damage of the consumer product 32 may also signal potential buyers of the nature or origin of the consumer product (i.e., it was stolen).

Figure 6:
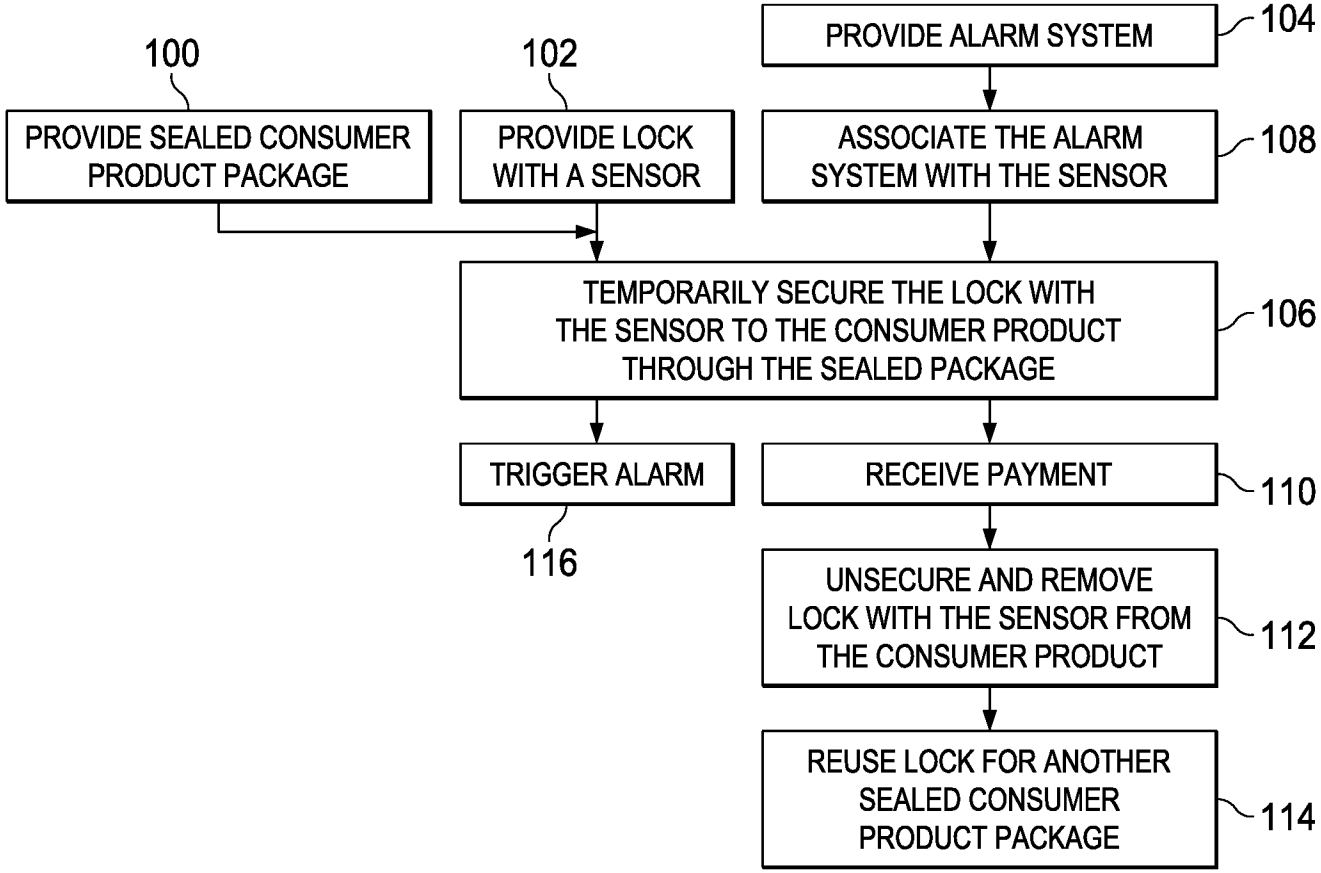
FIG. 6 is a schematic view of a method for providing the point of sale assembly having antitheft functionality.

Referring to FIG. 6, a schematic view is shown of a method of providing a point of sale assembly having anti-theft functionality. It is understood that the various steps may be rearranged and some steps are optional. In a first set of steps 100, 102 and 104, the alarm system 5, the lock 14 having the sensor 20, and the sealed consumer product package 12 containing the consumer product 32 may be provided. The lock 14 with the sensor 20 may be temporarily secured to the consumer product 32 in step 106. It is understood that the sensor 20 may be attached to the lock 14 either before or after securing the lock 14 to the consumer product package 32. As previously described, the lock 14 may be temporarily secured to the consumer product 32 through the sealed consumer product package 12. The sensor 20 may be associated with the alarm system 5 in step 108 either before or after the lock 14 is secured to the consumer product 32. In step 110, payment is received for the sealed consumer product package 12 and then the lock 14 is unsecured and removed from the consumer product 32 in step 112. The lock 14 may be reused (e.g., secured to another consumer product 32 in a similar fashion) in step 114. In certain embodiments, once the sensor 20 is associated with the alarm system 5, the sensor 20 may never be deactivated. Accordingly, the lock 14 with the sensor 20 must be removed in order not to set off the alarm system. Not having to deactivate the sensor 20 may simplify the process and reduce false triggering of the alarm system 5. If the lock 14 with the sensor 20 is not removed, for example, because payment was never received, then the sensor 20 activates the alarm in step 116.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A point of sale assembly having antitheft functionality comprising:

a sealed consumer product package having a face with two spaced apart openings extending into the package dimensioned to receive at least a portion of a lock;

a consumer product positioned inside the package;

the lock having a sensor, wherein the lock has a body positioned outside the sealed consumer product package and at least one locking arm extending into the opening of the sealed consumer product package and secured to the consumer product, wherein the lock comprises a pair of locking arms extending into the corresponding pair of openings and are secured to the consumer product and the consumer product comprises a dispenser having an undercut that engages the locking arm.

2. The point of sale assembly having antitheft functionality of claim 1 further comprising a plurality of razors cartridges positioned within a plurality of openings defined by the dispenser.

3. A consumer product comprising:

a sealed consumer product package defining a cavity, the sealed consumer product package having a face with at least one opening dimensioned to receive a locking arm;

an organizer positioned within the cavity; wherein the organizer has at least one engagement surface aligned with the at least one opening.

4. The consumer product of claim 3 further comprising a lid covering the cavity wherein the at least one opening extends through the lid.

5. The consumer product of claim 4 wherein the engagement surface comprises an undercut.

6. The consumer product of claim 5 wherein the face has a pair of spaced apart openings that are generally aligned with a pair of engagement surfaces on the dispenser.

7. The consumer product of claim 6 wherein the pair of engagement surfaces generally are parallel to each other.

* * * * *